US006569029B1

(12) United States Patent
Hamburger

(10) Patent No.: US 6,569,029 B1
(45) Date of Patent: May 27, 2003

(54) GOLF CLUB HEAD HAVING REPLACEABLE BOUNCE ANGLE PORTIONS

(76) Inventor: Edward Hamburger, 4730 Morris Lake Cir., West Bloomfield, MI (US) 48323

( * ) Notice: Subject to any disclaimer, the term of this patent is extended or adjusted under 35 U.S.C. 154(b) by 0 days.

(21) Appl. No.: 09/938,211

(22) Filed: Aug. 23, 2001

(51) Int. Cl.[7] ..... A63B 69/36; A63B 53/06

(52) U.S. Cl. ..... 473/238; 473/288; 473/336; 473/338; 473/244

(58) Field of Search ..... 473/328, 324, 473/244, 245, 288, 334, 335, 336, 337, 338, 339, 246, 248, 226, 238, 344, 350; D21/752, 753

(56) References Cited

U.S. PATENT DOCUMENTS

| | | | | |
|---|---|---|---|---|
| 2,328,583 | A | * | 9/1943 | Reach |
| 2,332,342 | A | * | 10/1943 | Reach |
| 3,893,670 | A | | 7/1975 | Franchi |
| 4,121,832 | A | | 10/1978 | Ebbing |
| 4,498,673 | A | * | 2/1985 | Swanson |
| 4,775,156 | A | | 10/1988 | Thompson |
| 4,869,507 | A | | 9/1989 | Sahm |
| 5,275,413 | A | | 1/1994 | Sprague |
| 5,301,944 | A | * | 4/1994 | Koehler |
| 5,439,223 | A | | 8/1995 | Kobayashi |
| 5,509,660 | A | | 4/1996 | Elmer |
| 5,518,242 | A | | 5/1996 | Mahaffey et al. |
| 5,518,243 | A | | 5/1996 | Redman |
| 5,549,296 | A | * | 8/1996 | Gilbert |
| 5,800,281 | A | | 9/1998 | Gilbert |
| 5,807,186 | A | | 9/1998 | Chen |
| 5,839,974 | A | | 11/1998 | McAllister |
| 5,938,540 | A | | 8/1999 | Lu |
| 5,971,866 | A | * | 10/1999 | Adams |
| 6,077,171 | A | | 6/2000 | Yoneyama |
| 6,093,113 | A | * | 7/2000 | Mertens |
| 6,106,410 | A | * | 8/2000 | Glod |

* cited by examiner

*Primary Examiner*—Sebastiano Passaniti
(74) *Attorney, Agent, or Firm*—MacMillan, Sobanski & Todd, LLC

(57) ABSTRACT

A golf club head having a body including a striking surface and a lower portion which couples with one of a plurality of flanges adapted to be fastened to the lower portion of the body. Each flange is configured to have a lower ground engaging surface defining a predetermined bounce angle such that replacing one of the plurality of flanges alters the bounce angle of the head. Preferably, the flange includes a plurality of cavities for receiving interchangeable weights for altering the weight characteristics of the club head.

17 Claims, 2 Drawing Sheets

GOLF CLUB HEAD HAVING REPLACEABLE BOUNCE ANGLE PORTIONS

BACKGROUND OF THE INVENTION

This invention relates in general to golf clubs, and in particular to an iron-type golf club having interchangeable components to alter the characteristics of the club head.

Golf clubs generally include a shaft, a hand grip attached to one end of the shaft, and a head attached to the other end of the shaft. The head includes a generally flat striking surface for hitting a golf ball with a relatively high impact force. A golfer generally uses a set of iron-type clubs having varying loft angles. The loft angle is generally defined as the angle between the striking surface and the axis of the shaft or to the horizontal. The golfer selects one of a plurality of iron-type clubs based upon the distance that the golf ball is to be hit and the desired back spin on the ball. For relatively short distances and/or when the golf ball is in a sand environment, a golfer generally selects a club commonly referred to as a wedge. A wedge is generally defined as an iron-type club having a relatively high loft angle. The head of the wedge may also be heavier than the heads of other iron-type clubs.

Most wedges, and other iron-type clubs, include a bottom surface which is angled from the ground, commonly referred to as the bounce angle of the club head. The bounce angle can be any desired angle. Generally, long iron-type clubs with low loft angles have a relatively low bounce angle or even a zero bounce angle such that the bottom surface of the club is generally parallel with the ground. Short iron-type clubs, such as wedges, have a relatively high bounce angle. The bounce surface is generally the first portion of the club head which engages the ground, sand, or grass surface of which the golf ball is hit from. Generally, a head with a higher bounce angle is easier to play from soft sand or grass because it will naturally fight the tendency to dig into the ground or sand. In general, the higher the bounce angle, the less the club head will dig into the sand. Instead, the head bounces or glides through the impact area just below the sand's surface, reducing the likelihood of digging too deep. A club head with less of a bounce angle tends to dig more into the ground, but is generally better for firm ground conditions when digging is more difficult so that the striking surface of the head hits squarely on the ball. Thus, a single integral club head is not always desirable depending on the characteristics of the golf course or based on the desired preference of the user of the club.

BRIEF SUMMARY OF THE INVENTION

This invention relates to a golf club head having a single body and a plurality of interchangeable bottom flanges to alter the bounce angle of the club head. The golf club head has a body which includes a striking surface for contact with a golf ball. The club head also includes a lower portion which couples with one of a plurality of flanges adapted to be fastened to the lower portion of the body. Each flange is configured to have a lower ground engaging surface defining a predetermined bounce angle such that replacing one of the plurality of flanges alters the bounce angle of the head. Preferably, the flange includes a plurality of cavities for receiving interchangeable weights for altering the weight characteristics of the club head.

Various objects and advantages of this invention will become apparent to those skilled in the art from the following detailed description of the preferred embodiment, when read in light of the accompanying drawings.

DETAILED DESCRIPTION OF THE INVENTION

Figure 1:
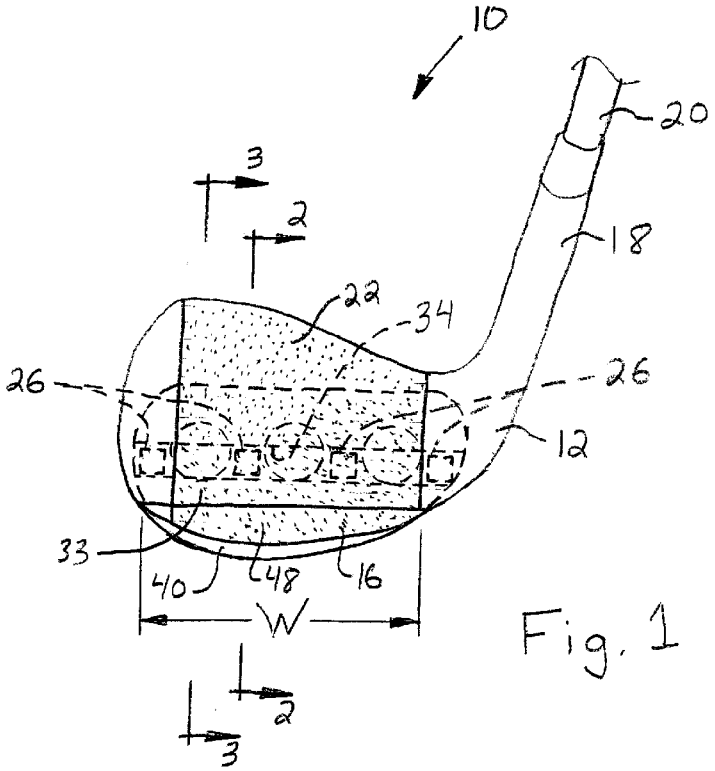
FIG. 1 is front elevational view of a first embodiment of a club head, in accordance with the present invention.
Figure 2:
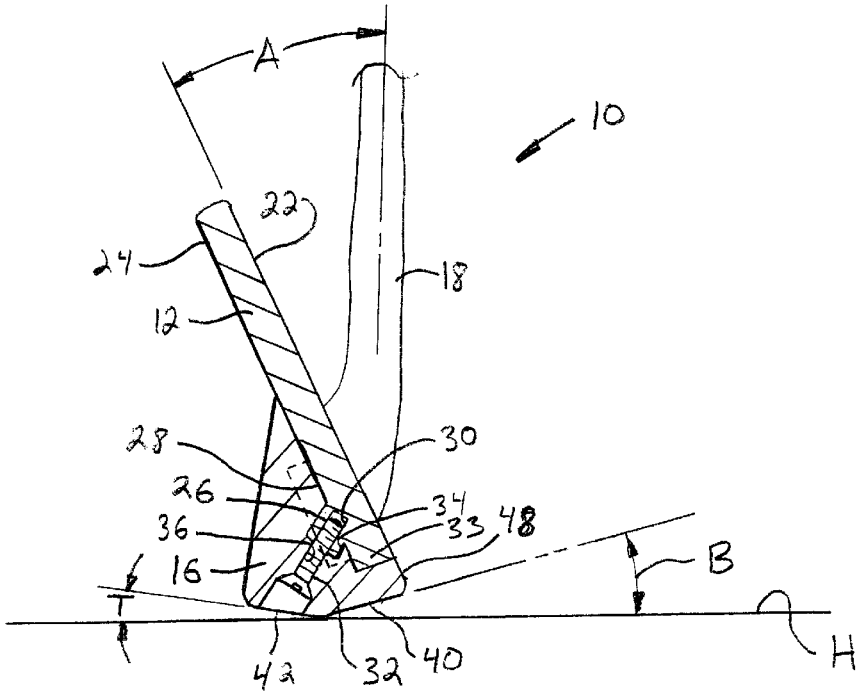
FIG. 2 is a cross-sectional view of the club head taken along lines 2—2 of FIG. 1.
Figure 3:
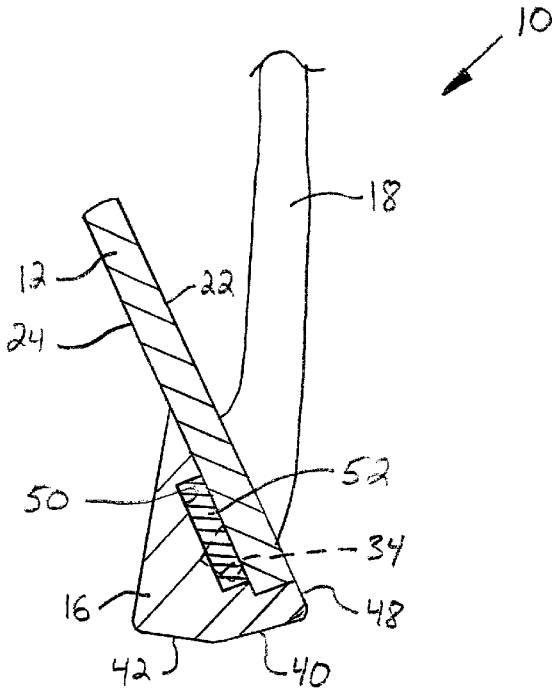
FIG. 3 is a cross-sectional view of the club head taken along lines 3—3 of FIG. 1.

Referring now to the drawings, there is illustrated in FIGS. 1 through 3 a first embodiment of a golf club head, indicated generally at 10, in accordance with the present invention. Although the head 10 can be any suitable golf club head arrangement, preferably the head 10 is an iron-type wedge club head. The head 10 is generally a two-piece configuration having a common single main body 12 and one of a plurality of flanges 16. Note that only one flange 16 is illustrated in FIG. 1. As will be explained below, the head 10 is designed so that the single main body 12 can be coupled with one of a variety of different flanges, such as the flange 16' illustrated in FIG. 4, to alter the shape, and in particular, the bounce angle of the club head 10. Preferably, the flanges 16 are removably fastened to the body 12 so that they are interchangeable. However, the head 10 could be configured so that a consumer selects one of the plurality of flanges 16 and permanently attaches a selected flange 16 to the body 12.

The body 12 of the head 10 preferably includes a hosel extension 18 for receiving and fastening a shaft 20 thereto. The shaft 20 can be fastened to the body 12 by any suitable manner. The body 12 also includes a generally flat striking surface 22 for impacting a golf ball. The striking surface 22 can include a textured region, indicated generally by the stippling illustrated in FIG. 1, for improved grip between the striking surface 22 and the golf ball. The body 12 has a rear side 24 which mates with the flange 16. The rear side 24 can have any desired shape. Preferably, the body 12 includes a plurality of bosses 26 extending from a surface 28 of the rear side 24. The rear surface 28 can be formed to any shape, such as generally planar. The bosses 26 include a threaded bore 30 formed therein for receiving a threaded fastener 32 to fasten the flange 16 to the body 12.

The flanges 16 are preferably removably fastened to the main body 12. The flanges 16 can be removably fastened to a lower portion 33 of the main body 12 by any suitable manner. For example, as shown in FIG. 1, the flange 16 includes a generally horizontally extending continuous recess 34 formed therein. The bosses 26 of the body 12 are placed within the recess 34 to properly position the flange 16 relative to the body 12. Note that the cross-sectional shape of the recess 34 is complimentarily to the cross-section shape of the bosses 26. The is flange 16 includes a plurality of holes 36 formed therein associated with the threaded bores 30 of the body 12 to receive the threaded fasteners 32. Preferably, the bosses 26 extend downwardly at an angle relative to the surface 28 of the rear side 24, such at about 45 degrees. This angled relationship of the bosses 26 is preferred over an embodiment where the bosses extend outwardly from the surface 28 in a direction normal to the surface 28 so that a force exerted on a bottom portion 3 8 of the flange is transmitted through the bosses 26 with less shear force acting on the bosses 26.

Although the embodiment of the club head 10 as illustrated in FIG. 1 includes four bosses 26, the body 12 can be configured with any suitable number of bosses. Alternatively, the body 12 could be configured with a single ledge (not shown) extending across the width of the rear side 24 and positioned within the recess 34.

The golf club head 10 can be any suitable club head, such as an "iron" type club head, and more preferably a "wedge" type club head which has a relatively high loft angle A, as shown in FIG. 2. Of course, the angle A can be any suitable angle. The loft angle A is generally defined as the angle between the striking surface 14 and the axis of the shaft 13. The loft angle may also be defined as the angle between the striking surface 14 and a generally horizontal plane, indicated at H in FIG. 2, as the club head 10 is positioned and oriented during normal use.

Figure 4:
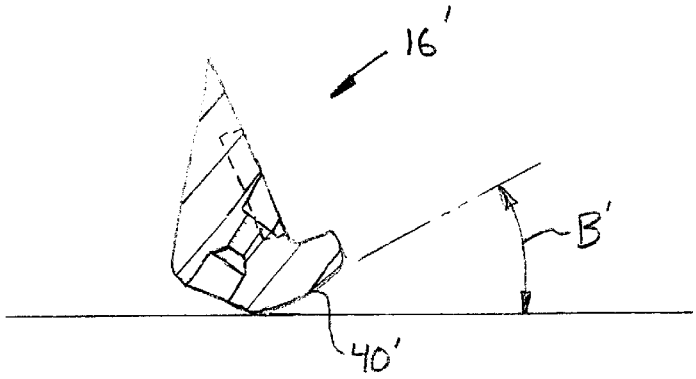
FIG. 4 is a cross-sectional view of an alternate embodiment of a replaceable flange for the club head of FIG. 1.

As previously stated, the head 10 is designed so that a plurality of differently shaped flanges 16 can be interchanged to change the characteristics of the head 10, and in particular to change a bounce angle B of the head, as shown in FIG. 2. The bounce angle B is generally defined by a lower ground engaging bounce surface 40 formed on the bottom portion 38 of the flange 16 and located generally in the front of the head 10 below the striking surface 22. The bounce surface 40 is generally formed at the bounce angle B relative to the horizontal. The bounce surface 40 is generally the first portion of the club head 10 which engages the ground, sand, or grass surface of which the golf ball is hit from. The cross-sectional shape of the bounce surface 40 can be relatively flat and planar, as shown in FIG. 2, or formed with a curved shape, as shown in FIG. 4. It should be understood that the bounce surface 40 can have any desired shape or contour suitable for club head movement in any particular environment. The bounce angle B and B' are generalizations of the angle the bounce surfaces are relative to the ground. For bounce surfaces which are curvilinear, the bounce angle B is an approximate angle. Note that as best shown in FIG. 1, the flange 16 and the bounce surface 40 generally extend along an entire bottom width W of the club, so that the flange 16 includes all of the ground engaging surfaces of the head 10. The bottom width W is generally defined as the portion of the head 10 which substantially engages the ground when the club head 10 is used. The lower portion of the main body 12 preferably does not include any ground engaging surfaces.

The flange 16 may also include a trailing surface 42 located behind the bounce surface 40 and formed at an angle T relative to the horizontal. The angle T can be any suitable angle. Of course, the flange 16 can be configured without a trailing surface 42 such that the bounce surface 40 generally extends across the entire bottom of the head 10.

Generally, a head with a higher bounce angle is easier to play from soft sand or grass because it will naturally fight the tendency to dig into the ground or sand. In general, the higher the bounce angle, the less the club head will dig into the sand. Instead, the head bounces or glides through the impact area just below the sand's surface, reducing the likelihood of digging too deep. A club head with less of a bounce angle tends to dig more into the ground, but is generally better for firm ground conditions when digging is more difficult so that the striking surface of the head hits squarely on the ball. Thus, it is sometimes desirable to alter the bounce angle B depending on the characteristics of the golf course. The club head 10 of the present invention includes a common main body 12 which can couple with one of a plurality of differently structured flanges 16. For example, there is illustrated in FIG. 4, an alternate embodiment of a flange, indicated generally at 16' which has a bounce surface 40' generally formed at a bounce angle B' which is greater than the bounce angle B of the club head 10. Note that the cross-sectional shape of the bounce surface 40' is curvilinear in shape. It may also be desirable to alter the bounce angle to the desired preference of the user of the club. For example, a consumer may be able to easily purchase a customized club head by selecting one of the different styles of flanges 16 having a desired bounce angle B and fastening the flange 16 to the common main body 12. This reduces the manufacturing cost of the golf club head compared to providing many different styles of one-piece integral heads.

As shown in FIGS. 1 and 2, the flange 16 includes a striking surface 48 which is preferably flush and co-planar with the striking surface 22 of the body 12. When the flange 16 is fastened to the body 12, the striking surfaces 22 and 48 preferably form a single continuous planar surface.

The flange 16 preferably includes a plurality of cavities 50 for receiving interchangeable weights 52 to alter the weight characteristics of the head 10, thereby changing the feel and striking characteristics of the head 10. For example, the flange 30 or the body 12 can be weighted more heavily on the ends (or front and back) compared to the center to compensate for off-center or mis-hits to help stabilize the head 10 when striking the golf ball. The head 10 can also be selectively weighted to alter the overall weight of the head as desired by the user of the club. Preferably, the cavities 50 are oriented in a generally linear manner across the width of the flange, as shown in FIG. 4. As shown in FIG. 1, the flange 16 includes three cavities 50. Of course, any number of cavities 50 and weights 52 can be used. The weights 52 can be secured to the flange 16 by any suitable manner, such as by simple placement within the cavity 50 and trapped between the body 12 and the flange 16.

Preferably, a selection of different weights 52 is initially provided from which suitable weights are selected and positioned within the cavities 50 to obtain the desired feel and striking characteristics of the club head 10. The weights 52 can be made of any suitable material, such as metal or plastic, and are preferably sized to snugly fit within the cavities 50. The length of the weights 52 can be less than the depth of the cavity 50, so that less weight is distributed in the cavity 50. The remainder of the cavity 50 can then be filled with a relatively light weight plastic plug (not shown) to fill the void of the cavity 50 and to prevent the weight 52 from moving within the cavity 50. The weights 52 and the cavities 50 can have any size and shape. If desired, the club head 10 could be configured such that cavities (not shown) are formed in the body 12 to receive the weights 52.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A golf club head for mounting on a shaft, comprising:

a body having a striking surface and a lower portion; and one of a plurality of flanges adapted to be fastened to said lower portion of said body, each flange having a ground engaging surface extending from a front edge of said flange located adjacent said striking surface to a lowermost sole point and defining a predetermined bounce angle relative to the club shaft and wherein each flange is configured to have a lower ground engaging surface defining a different predetermined bounce angle such that replacing one of the plurality of flanges alters the bounce angle of the head.

2. The golf club head of claim 1, wherein said plurality of flanges are removably fastened to said body.

3. The golf club head of claim 1, wherein each of said plurality of flanges includes a second striking surface, and wherein said second striking surface is co-planar with said striking surface of said body when said flange is fastened to said body.

4. The golf club head of claim 1, wherein said body defines a rear surface and includes a boss extending outwardly from said rear surface, and wherein said boss is disposed in a recess formed in each of said plurality of flanges when said flange is fastened to said body.

5. The golf club head of claim 4, wherein said body includes a plurality of bosses extending outwardly from said rear surface.

6. The golf club head of claim 5, wherein said recess is an elongated slot, and wherein said plurality of bosses are disposed in said slot when said flange is fastened to said body.

7. The golf club head of claim 4, wherein said boss extends outwardly from said rear surface at an angle.

8. The golf club head of claim 4, wherein said boss includes a threaded bore formed therein for receiving a threaded fastener to fasten said flange to said body.

9. The golf club head of claim 1 further including a plurality of interchangeable weights disposed therein for altering the weight characteristics of said head.

10. The golf club head of claim 9, wherein said plurality of flanges include cavities for receiving said weights.

11. The golf club head of claim 10, wherein said cavities are arranged in a generally linear manner across the width of said flange.

12. A golf club head for mounting on a shaft, comprising:

a body having a striking surface and a lower portion; and one of a plurality of flanges adapted to be fastened to said lower portion of said body, each flange having a ground engaging surface extending from a front edge of said flange located adjacent said striking surface to a lowermost sole point and defining a predetermined bounce angle relative to the club shaft and wherein each flange is configured to have a lower ground engaging surface defining a different predetermined bounce angle such that replacing one of the plurality of flanges alters the bounce angle of the head, and wherein each flange includes a cavity for receiving one of a plurality of interchangeable weights for altering the weight characteristics of said head.

13. The golf club head of claim 12, wherein said plurality of flanges are removably fastened to said body.

14. The golf club head of claim 12, wherein each of said plurality of flanges includes a second striking surface, and wherein said second striking surface is co-planar with said striking surface of said body when said flange is fastened to said body.

15. The golf club head of claim 12, wherein said body defines a rear surface and includes a boss extending outwardly from said rear surface, and wherein said boss is disposed in a recess formed in each of said plurality of flanges when said flange is fastened to said body.

16. The golf club head of claim 12, wherein said plurality of flanges include cavities for receiving said weights.

17. The golf club head of claim 16, wherein said cavities are arranged in a generally linear manner across the width of said flange.

* * * * *